US008788277B2

(12) United States Patent
Vezyrtzis et al.

(10) Patent No.: US 8,788,277 B2
(45) Date of Patent: Jul. 22, 2014

(54) APPARATUS AND METHODS FOR PROCESSING A SIGNAL USING A FIXED-POINT OPERATION

(75) Inventors: Christos Vezyrtzis, New York, NY (US); Aaron Klein, Flushing, NY (US); Yannis Tsividis, New York, NY (US); Daniel P. W. Ellis, New York, NY (US)

(73) Assignee: The Trustees of Columbia University in the City of New York, New York, NY (US)

( * ) Notice: Subject to any disclaimer, the term of this patent is extended or adjusted under 35 U.S.C. 154(b) by 543 days.

(21) Appl. No.: 12/880,858

(22) Filed: Sep. 13, 2010

(65) Prior Publication Data

US 2011/0116551 A1 May 19, 2011

Related U.S. Application Data

(60) Provisional application No. 61/241,788, filed on Sep. 11, 2009.

(51) Int. Cl.
*G10L 19/00* (2013.01)

(52) U.S. Cl.
USPC ..... 704/500

(58) Field of Classification Search
USPC ..... 704/500–504
See application file for complete search history.

(56) References Cited

U.S. PATENT DOCUMENTS 5,764,698 A * 6/1998 Sudharsanan et al. ..... 375/241
6,389,445 B1 * 5/2002 Tsividis ..... 708/819
7,106,715 B1 * 9/2006 Kelton et al. ..... 370/338
7,315,822 B2 * 1/2008 Li ..... 704/500
7,333,034 B2 * 2/2008 Matsumoto et al. ..... 341/61
7,599,840 B2 * 10/2009 Mehrotra et al. ..... 704/501
7,602,320 B2 * 10/2009 Klein et al. ..... 341/110
7,684,981 B2 * 3/2010 Thumpudi et al. ..... 704/230
7,693,709 B2 * 4/2010 Thumpudi et al. ..... 704/205
2001/0004397 A1 * 6/2001 Kita et al. ..... 381/334
2005/0083216 A1 * 4/2005 Li ..... 341/50
2005/0157884 A1 * 7/2005 Eguchi ..... 381/23
2005/0256723 A1 * 11/2005 Mansour ..... 704/500

OTHER PUBLICATIONS

Oppenheim, Alan V., et al., "Realization of Digital Filters Using Block-Floating-Point Arithmetic", IEEE Transactions on Audio and Electroacoustics, Jun. 1970, vol. Au-18, No. 2, pp. 130-136.
Lanciani, Chris A., et al., "Subband-Domain Filtering of MPEG Audio Signals", Proc. 1999 IEEE ICASSP, pp. 917-920.
Vezyrtzis, Christos, et al., "Direct Processing of MPEG Audio Using Companding and BFP Techniques", Department of Electrical Engineering, Columbia University, New York, IEEE ICASSP 2011, pp. 361-364.

(Continued)

*Primary Examiner* — Michael N Opsasnick
(74) *Attorney, Agent, or Firm* — Wilmer Cutler Pickering Hale and Dorr LLP

(57) ABSTRACT

Apparatus and methods for processing compression encoded signals are provided. In some embodiments, a signal processing method is provided that includes receiving a subband of a compression encoded signal at a subband processor, generating envelope information regarding the subband of the compression encoded signal to provide changes in the dynamic range of the compression encoded signal for fixed-point digital signal processing, processing the compression encoded signal with a fixed-point companding digital signal processor using the envelope information, and producing a processed compression encoded signal at the output of the subband processor.

20 Claims, 6 Drawing Sheets

(56) References Cited

OTHER PUBLICATIONS

Tsividis, Yannis P., et al., "A Segmented μ-255 Law PCM Voice Encoder Utilizing NMOS Technology", IEEE Journal of Solid-State Circuits, Dec. 1976, vol. SC-11, No. 6, pp. 740-747.
Touimi, A. B., "A Generic Framework for Filtering in Subband-Domain", First Signal Processing Education Workshop, 2000, http://spib.ece.rice.edu/DSP2000/program.html, 13 pages.
Sridharan, S., "Implementation of State-Space Digital Filter Structures Using Block Floating-Point Arithmetic", Proc. 1987 IEEE ICASSP, pp. 908-911.
Ralev, Kamen R., et al., "Realization of Block Floating-Point Digital Filters and Application to Block Implementations", IEEE Transactions on Signal Processing, Apr. 1999, vol. 47, No. 4, pp. 1076-1086.
Ralev, Kamen, et al., "Implementation Options for Block Floating Point Digital Filters", 1997 IEEE ICASSP, Apr. 1997, pp. 2197-2200.
Pan, Davis, "A Tutorial on MPEG/Audio Compression", IEEE Mutt. Med., Summer 1995, pp. 60-74.
Levine, Scott N., "Effects Processing on Audio Subband Data", ICMC Proceedings 1996, pp. 328-331.
Krishnapura, N., et al., "Companding Switched Capacitor Filters", Proc. 1998 IEEE ISCAS, May 1998, pp. 480-483.
Klein, Aaron E., et al., "Externally Linear Time Invariant Digital Signal Processors", IEEE Transactions on Signal Processing, Sep. 2010, vol. 58, No. 9, pp. 4897-4909.
Klein, Aaron, et al., "Externally Linear Discrete-Time Systems with Application to Instantaneously Companding Digital Signal Processors", IEEE Transactions on Circuits and Systems I, Nov. 2011, vol. 58, No. 11, pp. 2718-2728.
Klein, Ari, et al., "Instantaneously Companding Digital Signal Processors", IEEE ICASSP 2007, pp. III-1433-III-1436.
Klein, Ari, et al., "Companding Digital Signal Processors", Proc. 2006 IEEE ICASSP, May 2006, vol. 3, pp. III700-III-703.
Kalliojärvi, Kari, et al., "Roundoff Errors in Block-Floating-Point Systems", IEEE Transactions on Signal Processing, Apr. 1996, vol. 44, No. 4, pp. 783-790.

* cited by examiner

APPARATUS AND METHODS FOR PROCESSING A SIGNAL USING A FIXED-POINT OPERATION

CROSS-REFERENCE TO RELATED APPLICATIONS

This application claims the benefit under 35 U.S.C. §119 (e) of U.S. Provisional Patent Application No. 61/241,788, entitled "Apparatus and Methods for Processing Compression Encoded Signals," filed Sep. 11, 2009, which is hereby incorporated by reference herein in its entirety.

STATEMENT REGARDING FEDERALLY SPONSORED RESEARCH OR DEVELOPMENT

This invention was made with government support under CCF-0701766 awarded by National Science Foundation (NSF). The government has certain rights in the invention.

TECHNICAL FIELD

This disclosure relates to apparatus and methods for processing compression encoded signals.

BACKGROUND

A digital signal processor (DSP) is used to process digital signals, which have discrete values represented in the signal. There are typically two types of DSPs: floating-point DSPs and fixed-point DSPs. Generally, a floating-point DSP uses a certain number of bits to represent the mantissa of a signal's value and another set of bits to represent the exponent of the signal's value. For example, for a large signal, which may be quantified as 1126.4, which is 1.1 times $2^{10}$, a floating point representation may be 1.1 for the mantissa and 10 for the exponent. Floating-point DSPs thus provide the ability to represent a very wide range of values, but with a precision that is limited by the number of bits used to represent the mantissa.

Unlike a floating-point DSP, a fixed-point DSP uses all of its bits to represent a signal's value. The precision of the fixed-point DSP is determined by dividing its range by the number of discrete values that can be represented by the available bits in the DSP. Thus, for example, if a DSP is to process signals having a range of 0-16 and it has three available bits, which can represent eight discrete values, then the least significant bit carries a value of two. Fixed-point DSPs can experience problems, however, with signals that are not sized well to the DSP. For example, in a 21-bit fixed point system, if the least significant bit is set to 1, the DSP can only handle signals having values up to 2,097,152, and therefore a signal with the value of 3,676,000 will not be properly processed. As another example, if the signal's value is small (e.g., 10) and changes to the signal's value are small (e.g., +/−1.4) compared to the range of the fixed-point DSP (e.g., 2,097,152), quantization noise from rounding problems may result in a degradation of signal quality because the least significant bit is larger than, or a large portion of, the changes to the signal's value. In contrast, in a floating-point DSP, the mantissa and exponent may be used to represent decimal values so that rounding errors are minimized.

Currently, floating-point DSPs are used in applications where the range of a signal's value varies. This is because the floating-point DSPs can adjust to the change in range by using exponent bits. Nevertheless, it is often desirable to use fixed-point DSPs instead, because fixed-point DSPs typically consume less power, are cheaper, and are fabricated in less chip area compared to floating-point DSPs.

Compression encoded signals include digital signals that have been compressed and encoded in a format, such as an MPEG format. Typically, these compression encoded signals are processed using floating point DSPs exclusively. It is desirable to provide fixed-point DSPs that can be used in processing compression encoded signals, without the problems typically associated with fixed-point DSPs, such as significant quantization noise or overflow.

SUMMARY

This disclosure relates to apparatus and methods for processing compression encoded signals. Compression encoded signals are compressed signals. Certain techniques can take advantage of the compressed nature of the signal to introduce a special way of processing the signal. Once of these techniques is companding, which involves the compression and decompression of a signal. Since a compressed encoded signal is already compressed, companding processing can be manipulated to be applied directly to the compressed encoded signal. Companding techniques such as syllabic companding and block floating point are presented for processing compression encoded signals during the decoding process, using efficient fixed-point arithmetic operations. The efficient fixed-point arithmetic operations provide an advantage in terms of speed, power, and cost over using floating-point operations to achieve the same processing.

In some embodiments, a digital signal processor is provided that includes an input for receiving a subband of a compression encoded signal and a subband processor coupled to the input that is configured to process the subband of the compression encoded signal. The subband processor further includes a fixed-point companding digital signal processor that is configured to receive the subband of the compression encoded signal and process the subband of the compression encoded signal using envelope information that describes characteristics of the compression encoded signal to produce a processed compression encoded signal. The subband processor further includes an envelope generator that is configured to produce envelope information regarding the subband of the compression encoded signal to provide changes in the dynamic range of the compression encoded signal for fixed-point digital signal processing.

In one example, the fixed-point companding digital signal processor uses syllabic companding in processing the subband of the compression encoded signal. In another example, the envelope generator implements a look up table to convert from a compression encoded signal scale factor and a normalized subband sample to a scale factor that is an integer power of two and a re-normalized subband sample corresponding to the power-of-two scale factor. In yet another example, the compression encoded signal is an MPEG layer 2 (MP2) signal.

In still another example, the digital signal processor further includes a decoder that partially decodes a received compression encoded signal and provides a partially decoded signal to the subband processor that is time domain based. The compression encoded signal may be, for example, an MPEG layer 3 (MP3) signal and the partially decoded signal is an MPEG layer 2 signal.

In accordance with the disclosed subject matter, corresponding methods and software are also provided.

DETAILED DESCRIPTION

Figure 1:
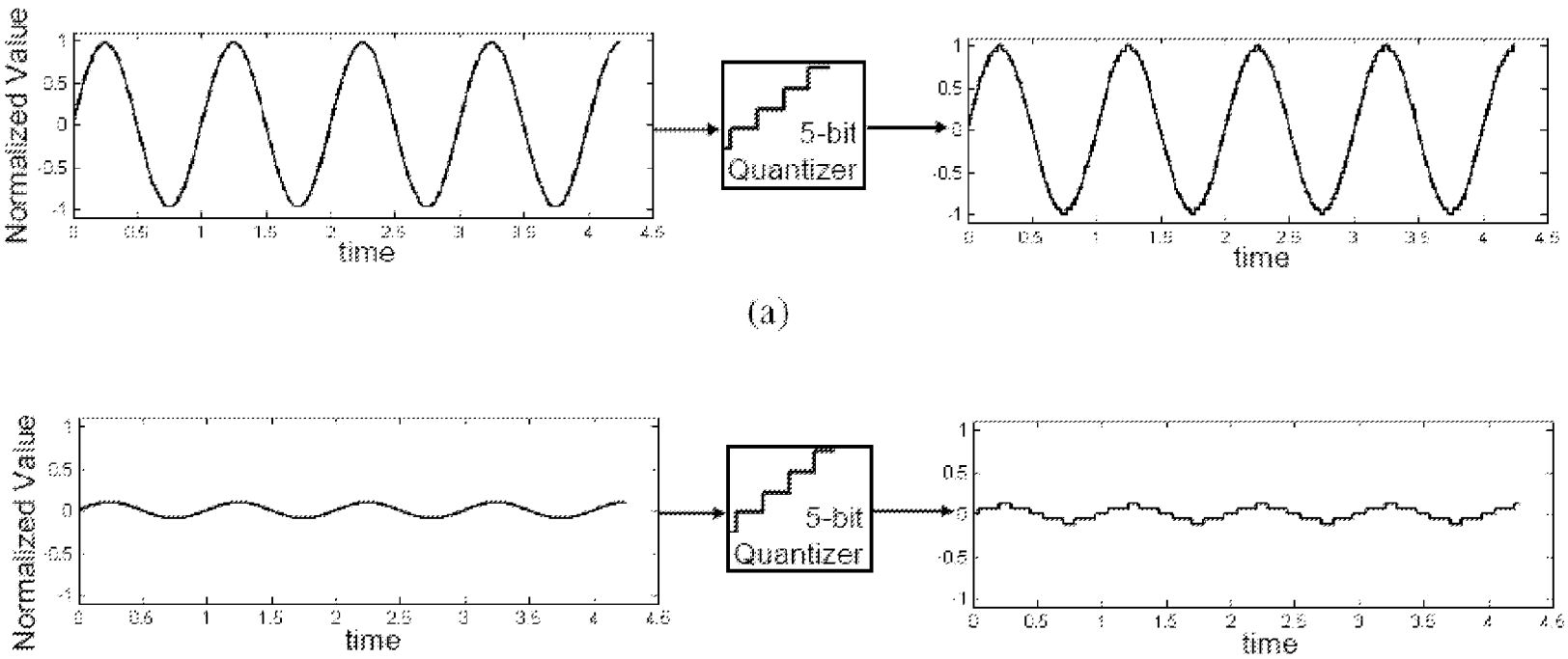
FIG. 1 illustrates quantization of signals depending on signal size.

This disclosure relates to apparatus and methods for processing compression encoded signals. Compression encoded signals are signals that are compressed and encoded for storage and use. Certain techniques can take advantage of the compressed nature of the signal to introduce a special way of processing the signal. One of these techniques is companding, which involves the compression and decompression of a signal. Since a compressed encoded signal is already compressed, companding processing can be manipulated to be applied directly to the compressed encoded signal. Examples of compression encoded signals include MPEG, which further includes well-known formats such as MP3 and advanced audio coding (AAC), where the formats generally dictate the encoding and compression performed on the signal. These compression encoded signals are typically processed in digital signal processors (DSPs).

Generally, the DSPs processing compression encoded signals are floating point DSPs. This is because the floating-point DSPs can adjust to the change in range by using exponent bits. Nevertheless, it is desirable to use fixed-point DSPs instead, because fixed-point DSPs typically consume less power, are cheaper, and are fabricated in less chip area compared to floating-point DSPs. In this disclosure, techniques are presented for processing compression encoded signals during the decoding process using efficient fixed-point arithmetic operations. In certain embodiments, these processing techniques exploit the compressed nature of compression encoded signals to minimize quantization distortion such that it is largely inaudible, even though only low-resolution fixed-point operations are used in the processing. This allows processing on a fixed-point DSP, while maintaining signal quality.

Companding (compressing/expanding) is a technique used in transmission and sound recording to compress the dynamic range (DR) of input signals; at the output, the dynamic range is restored (expanded). The compression can be accomplished, for example, by using root-mean-square information or envelope information. For audio applications, envelope-based or root-mean-square-based companding is referred to as "syllabic" companding, as the amount of compression is roughly constant for each syllable, and usually only varies between syllables. The compression can also be accomplished via memoryless nonlinear functions; this type of companding is referred to as "instantaneous" companding, as the compression and expansion depend only on the instantaneous values of signals. Since, generally, the channel or storage medium does not modify the signal, the expansion operation is simply the inverse of the compression operation. Thus, for syllabic companding, if, for example, the input is compressed through a division by the input envelope, then the expansion is usually a multiplication by this same envelope signal. For instantaneous companding, if compression is accomplished via some invertible, nonlinear, "compressive" function with desirable properties, then expansion is accomplished by applying the inverse of the compressive function.

Figure 2:
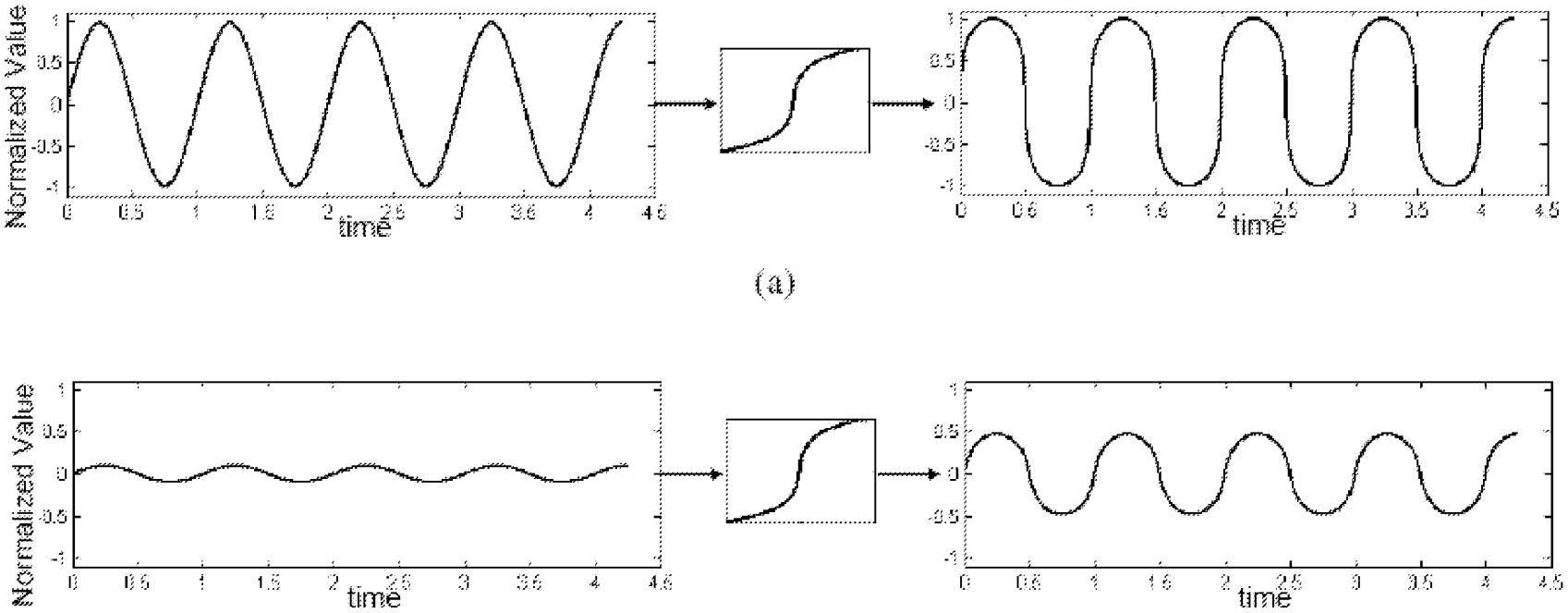
FIG. 2 illustrates resizing of a signal with a non-linear function in accordance with certain embodiments.

FIGS. 1 and 2 illustrate an example of why dynamic range is important in digital systems. In FIG. 1*a*, the quantization in a fixed-point system is largely unnoticeable, while in FIG. 1*b*, a small signal is not accurately represented by the quantizer. Companding can be used to compress and expand signals to reduce the noise associated with digital processing. FIG. 2 illustrates an example of how a non-linear function can be used in companding to reduce the noise associated with digital processing. In FIG. 2*a*, the sharp transitions of the signal are smoothed in order to spread quick transitions. In FIG. 2*b*, small signals that would suffer from quantization errors can be scaled to reduce these errors (as shown in FIG. 1*b*). These companding techniques allow the signals "seen" by the data converters to be close to full-scale, which reduces errors and noise that would otherwise be associated with such processing.

These techniques can be advantageously applied to compression encoded signals in some embodiments. In terms of compression encoded signals, the MPEG-1 coding standard is one of the most popular and widely used standards for efficient and perceptually lossless audio compression coding, as MPEG encoded audio achieves very high perceived audio fidelity, together with high compression rates. In operation, MPEG uses a digital filterbank to create 32 narrowband filtered versions of a digital input signal, referred to as "subbands," each of which is downsampled by a factor of 32. The presence of a large signal in a particular subband makes noise in that subband perceptually inaudible; this phenomenon is known as "masking." In MPEG-1 layers I and II, 64 high-precision scale factors are used to compress the dynamic range of the subband samples (normalization).

The actual value of each subband sample is given by the normalized subband sample, multiplied with the corresponding scale factor; this multiplication is referred to as "denormalization." Processing of MPEG-encoded signals is conventionally performed by first fully decoding the input stream and then performing the desired processing. This method, which is referred to herein as "classical DSP," ignores certain features of MPEG audio encoding. The processor is forced to process a signal with high dynamic range, and with frequency content throughout the audio band. As a result, to avoid introducing significant audible quantization distortion, these subband processors are implemented in either very high resolution fixed-point or in floating point.

Figure 3:
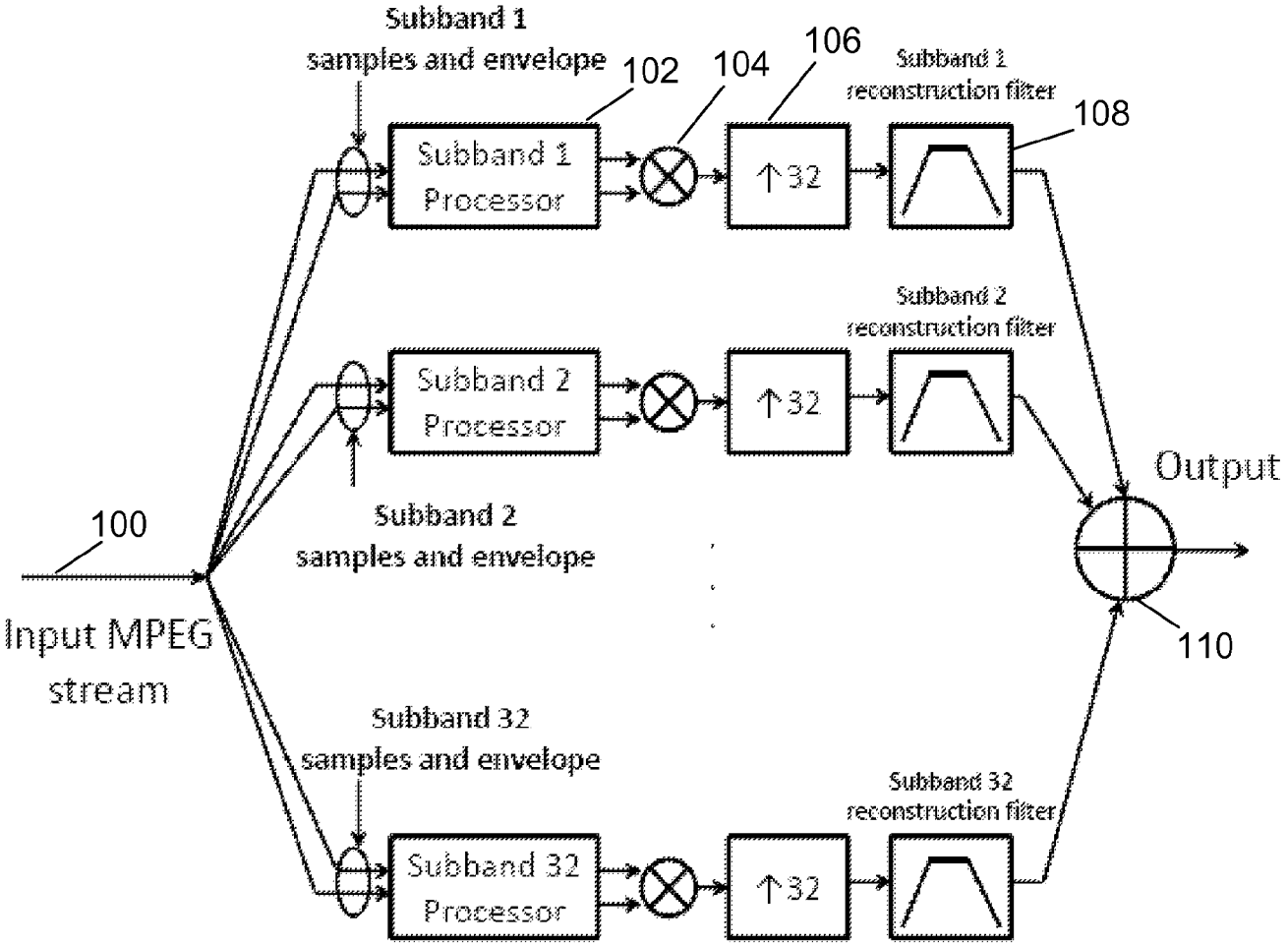
FIG. 3 illustrates a companding digital signal processor (DSP) implementation in accordance with certain embodiments.

In the embodiments described herein, processing is done prior to denormalization by using a syllabic companding DSP technique or a block-floating-point (BFP) technique. These techniques process the compressed input, along with corresponding input scale-factors, and yield compressed output, along with corresponding output scale factors. The resulting system-level block diagram is illustrated in FIG. 3, in accordance with certain embodiments. FIG. 3 includes a compressed encoded signal input 100, a subband processor 102, a (digital) multiplier 104, a (digital) up-sampler 106, a subband reconstruction filter 108, and an output collector 110. In operation, the multiplier components are used to perform denormalization on the signal. As shown in FIG. 3, for an MPEG stream there can be 32 subband processing paths. In some embodiments, the MPEG encoded signal is processed during decoding, before denormalization, which takes advantage of the compressed input and scale factors provided to us by the MPEG standard.

The subband processor 102 performs the desired processing on each sub-band of the compressed signal, before the de-normalization process. The processor can use an algorithm to implement the processing. The algorithm may be dependent on the type of processing that is being performed. For example, the processing can include changing the bass, treble, volume of the signal or adding reverberation to the signal. The adding of effects such as music sounding like it is in a concert hall or adjusting to other characteristics can be performed by the subband processor 102. The multipler 104 performs the de-normalization of the signal. The multipler 104 can be a simple multiplier, multiplying the compressed signal (which is large) with the corresponding envelope (which carries the information about the size of the actual signal), resulting in a decompressed sub-band signal.

The up-sampler 106 can perform discrete-time upsampling by a factor corresponding to the number of subbands. For MPEG, this factor is 32. Taking MPEG as an example, each sample at the input of up-sampler 106 results in 32 output samples. The spacing between each pair of the latter (samples) is 1/32 of the spacing between each pair of input samples. The sub-band reconstruction filter 110 processes a stream of sub-band samples so that they can be ready to be combined with the remaining sub-bands, by removing the "out-of-band" artifacts that were effectively inserted in each sub-band during the encoding process. The output collector 110 can be a digital multi-way adder. The output collector 110 combines (e.g., by means of a simple addition) the filtered sub-bands to create the final output.

The techniques described herein work best when the scale-factors correspond to the time-domain envelope of the sub-band samples. As such, MPEG 1-Layer II (MP2) is used to provide examples using this technique. MP2 is used for many applications, including digital-video-broadcasting (DVB) and DVD players. The companding subband processors can use few bits and simple low-bit fixed-point operations. Due to the compressed dynamic range of their input, state, and output signals, the resulting output signal to quantization distortion ratio (SNR) is always sufficiently high that the output quantization distortion is inaudible due to the masking properties of the MPEG reconstruction filterbank.

As a first example, the syllabic companding DSP technique is used to implement an all-pass reverberator prototype, described in state-space by the following equations:

$$x_1(n+1)=-0.8\cdot x_L(n)+0.2\cdot u(n)$$

$$x_i(n+1)=x_{i-1}(n), 2\le i\le L$$

$$y(n)=1.8\cdot x_L(n)+0.8\cdot u(n) \quad (1)$$

where L=2048 and the sampling rate for the input u(n), output y(n), and states $x_i(n)$ of the prototype is $f_s$=44.1 kHz. For this case, the technique can involve the insertion of 32 identical subband filters, each given by Eq. (1), but with L replaced by $$K=\frac{L}{32}=64;$$

this subband filter is referred to as the "subband-prototype." Here, it is desirable to process samples before denormalization, so the companding DSP technique is applied to the subband-prototype. Next externally applied control signals are introduced: $e_u(n)$, $e_y(n)$, and $e_{x_i}(n)$ signals, which are referred to as "e-controls", and normalized input, output and states $\hat{u}(n)$, $\hat{y}(n)$, and $\hat{x}_i(n)$, such that:

$$\hat{u}(n)=\frac{u(n)}{e_u(n)} \quad (2)$$

$$\hat{y}(n)=\frac{y(n)}{e_y(n)}$$

$$\hat{x}_i(n)=\frac{x_i(n)}{e_{x_i}(n)},\quad 1\le i\le K$$

By substituting (2) in (1), with subband processors described by the state equations:

$$\hat{x}_1(n+1)=\frac{-0.8e_{x_K}(n)}{e_{x_1}(n+1)}\cdot\hat{x}_K(n)+\frac{0.2e_n(n)}{e_{x_1}(n+1)}\cdot\hat{u}(n) \quad (3)$$

$$\hat{x}_i(n+1)\hat{x}_{i-1}(n),\quad 2\le i\le K$$

$$\hat{y}(n)=\frac{1.8e_{x_K}(n)}{e_y(n)}\cdot\hat{x}_K(n)+\frac{0.8e_u(n)}{e_y(n)}\cdot\hat{u}(n)$$

with K=64 and $e_{x_K}(n)=e_{x_1}(n-K+1)$. The e-controls can be constrained to be integer powers of 2, so that the ratios in Eq. (2) are efficiently implemented as subtractions of (integer) base-2 logarithms, and multiplying by the ratios is efficiently implemented with arithmetic bit-shift. Information about the input envelope for each subband is provided in MPEG in the form of a signal scale-factor. From this, the $e_u(n)$ control signal can be generated via a lookup table (LUT).

The LUT can include a 14-bit input: the 8-bit normalized input sample, concatenated with its corresponding 6-bit scale-factor index. The LUT outputs a 4-bit integer corresponding to the base-2 logarithm of the lowest integer power of 2 greater than the scale-factor, and a new 8-bit compressed subband sample corresponding to this power-of-2 scale factor. The new 8-bit sample is used as $\hat{u}(n)$ in Eq. (2), while the power-of-2 scale factor is used as $e_u(n)$ in Eq. (2). The remaining e-controls can be chosen to correspond, at least roughly, to the envelopes of the corresponding signals in the prototype, in order to maximize the dynamic range of the subband processor, and minimize the quantization distortion.

Figure 4:
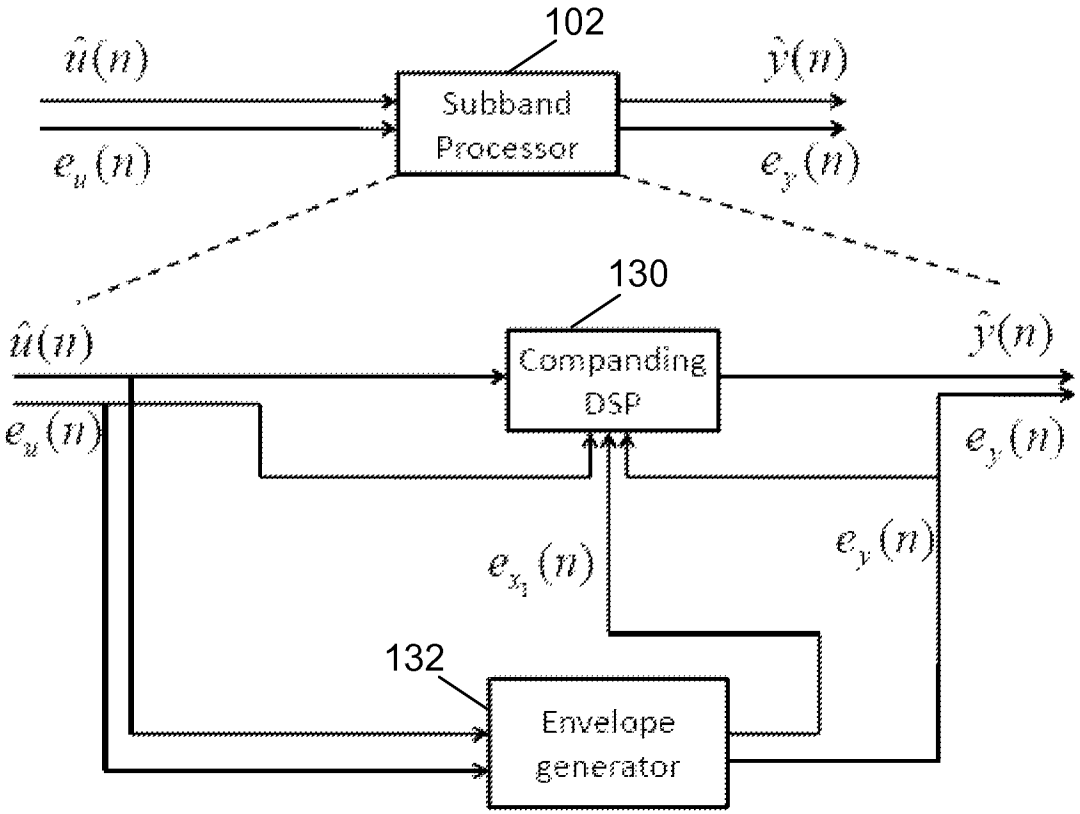
FIG. 4 illustrates a subband processor in accordance with certain embodiments.

FIG. 4 illustrates a subband processor in accordance with some embodiments. FIG. 4 illustrates a subband processor 102, which includes a companding DSP 130 and an envelope generator 132. The companding DSP 130 alters the input signal $\hat{u}(n)$ using e-controls that alter how the processing is performed and provide information regarding the characteristics of the signal. The companding processor can use an algorithm to provide the desired processing in conjunction with the processing. The processing can be performed by changing aspects of the signal $\hat{u}(n)$ in accordance with the e-controls and the specified processing. A different algorithm is used depending on the type of processing desired.

Envelope generator 132 can be used instead of a replica DSP to provide an estimation of the intermediate envelopes that are used in companding based processing (see Eq. (3)). The envelope generator 132 obtains the remaining e-controls used by the companding DSP 130. In some embodiments, a replica DSP can be used to calculate the remaining e-controls. This could be done here as well, using 32 low-resolution fixed-point implementations of the subband-prototype. However, implementing the replica DSPs adds significant overhead, so a more efficient technique has been devised for estimating the remaining e-controls. The algorithm, shown in block diagram format in FIG. 5, takes advantage of the narrowband nature of the subbands, and is described in detail in the following.

Figure 5:
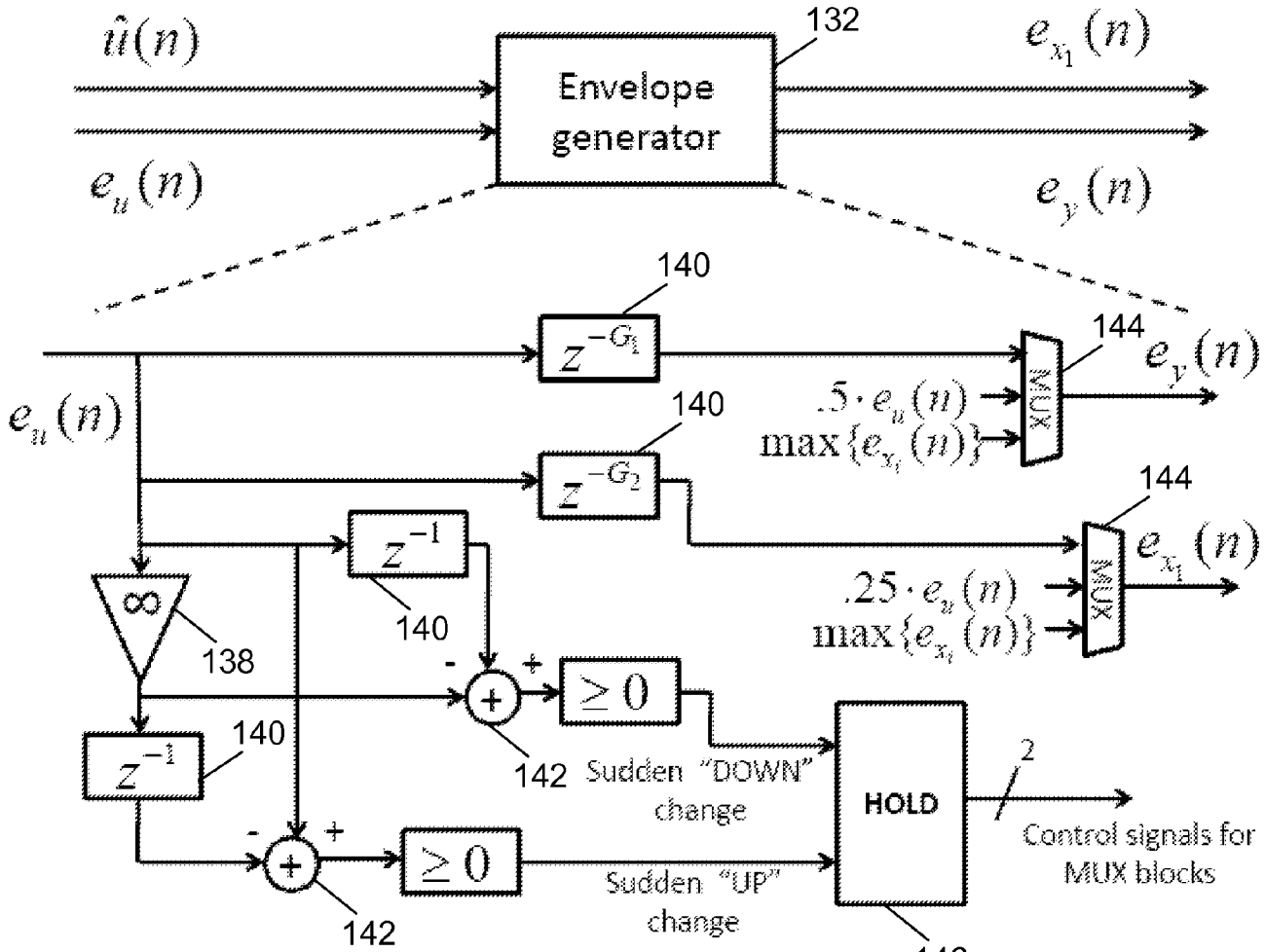
FIG. 5 illustrates a subband processor without a replica DSP in accordance with certain embodiments.

FIG. 5 illustrates a subband processor without a replica DSP in accordance with some embodiments. The internal components illustrated of envelope generator 132 in FIG. 5 include the compontents to implement an envelope generator for the case where the companding DSP 130 is implementing a digital reverberator. The envelope generator 132 estimates the envelopes of equations (3) based on the most recent input dynamics as well as the most recent dynamics internal to the system. The envelope generator 132 of FIG. 5 includes digital multipliers 138, delay blocks 140, comparators 142, and mutiplexers 144. The delay blocks 140 and digital multipliers 138 are used to keep a record of various old values of the input envelope. The comparators 142 compare the difference between previous values of the input envelope and the most recent input envelope with a certain threshold. Multiplexers 144 are used to choose the appropriate values for the envelopes used in equations (3) to provide e-controls. The multiplexers 144 are controlled by controller 146 that receives input from comparators 142.

In operation, the envelope generator detects changes in the input envelope, and can use scaling information and samples of the subband of the compression encoded signal. If the input envelope does not change by more than a pre-defined (emperically determined) amount, then the envelopes in equations (3) are assigned weighted versions of past values of the input envelope, according to the filter attributes. If the input envelope is detected to have changed by more than the predefined threshold, then the envelopes are assigned the value of the most recent input envelope. The envelope generator outputs this information as e-controls for the companding DSP.

The algorithm for the design of the envelope generator of FIG. 5 is based on the signals that are received. When a signal u(n), narrowband around a frequency $\omega_1$, is processed with an LTI filter, one can approximate u(n) with a single tone at frequency $\bullet_1$, so that the output is roughly $\tilde{y}(n)=A_1\cdot u(n-n_1)$, where $A_1$ is the magnitude of the filter's transfer function at frequency $\omega_1$, and $n_1$ is the group delay of the filter, rounded to the nearest integer, at frequency $\omega_1$. Thus, the envelope of y(n), $e_y(n)$, can be approximated with $A_1\cdot e_u(n-n_1)$. Similar results hold for the filter states.

The above discussion applies when there is no sudden change in the input, u(n), since until the system resettles after the sudden change, it cannot be viewed as above. It has been determined empirically that abrupt changes in u(n) are indicated by changes of more than a factor of 8 between consecutive values of $e_u(n)$ in Eq. (2). When no such change is detected, the subband signal can be considered to be narrowband. For the subband-prototypes, all input-state and input-output transfer functions are normalized such that their maxima are at 0 dB, so $A_1=1$. Thus, in Eq. (2), the output envelope of the companding DSP's output, $e_y(n)$, can be approximated by $e_u(n-G_1)$ and the first state's envelope, $e_{x_1}(n)$, by $e_u(n-G_2)$, where $G_1$ and $G_2$ are the corresponding group delays, rounded to the nearest integer.

The magnitude of the transfer function from the subband prototype's input, u(n), to its $K^{th}$ state, $x_K(n)$, was simulated to range from −15 dB to 0 dB. Thus, when there have been no recent abrupt input envelope changes, $e_u(n)$ and $e_{x_K}(n)$ differ by at most one order of magnitude. When there are abrupt input envelope changes, $e_u(n)$ temporarily is either much larger or much smaller than $e_{x_K}(n)$. In the subband prototypes, given by Eq. (1), but with L replaced by $$K=\frac{L}{32},$$

it is seen that $x_1(n+1)$ and y(n) are both composed of two components: one depending on the input, u(n), and the other on the $K^{th}$ state, $x_K(n)$.

When there is an abrupt input envelope change, one or the other component will dominate in determining the envelopes of $x_i(n+1)$ and y(n), allowing us to use simple approximations for these envelopes. Specifically, for sudden increases in $e_u(n)$, $e_u(n)$ temporarily becomes significantly larger than $e_{x_K}(n)$, so in Eq. (2), $e_y(n)$ can be approximated as $0.8\cdot e_u(n)$, and $e_{x_1}(n)$ as $0.2\cdot e_u(n)$. Since exact integer powers of 2 are used for $e_u(n)$, and it is desirable for $e_y(n)$ and $e_{x_1}(n)$ to be exact integer powers of 2, $e_y(n)$ is approximated as $0.5\cdot e_u(n)$ and $e_{x_1}(n)$ as $0.25\cdot e_u(n)$. This also results in a simpler implementation, as $e_y(n)$ and $e_{x_1}(n)$ can be computed from $e_u(n)$ by subtracting 1 or 2, respectively, from the integer power of 2 stored for $e_u(n)$. These assignments are carried for at least $G_1$ samples, after which the envelopes can again be estimated via the group delays, until a new abrupt input jump is detected. Similarly, for sudden decreases in $e_u(n)$, both $e_y(n)$ and $e_{x_1}(n)$ can be approximated as max $\{e_{x_i}(n)\}$ until a new abrupt input jump is detected.

The above described functionality is shown in FIG. 5. Even though minimal extra hardware is used in this implementation, its performance will be seen to yield high output SNR over a large input dynamic range, and excellent perceived audio quality.

Another way to process samples before denormalization is to apply a block floating point (BFP) technique, to provide input and output compression in addition to state-variable compression. In some embodiments, scaling signals $g_u(n)$, $g_y(n)$, and $g_i(n)$, referred to as "g-controls", and normalized input, output and states $\hat{u}(n)$, $\hat{y}(n)$, and $\hat{x}_i(n)$, such that:

$$\hat{u}(n)=g_u(n)\cdot u(n)$$

$$\hat{y}(n)=g_y(n)\cdot y(n)$$

$$\hat{x}(n)=g_i(n)\cdot x_i(n),1\le i\le K \tag{4}$$

Here this technique is applied to the subband prototypes of the previous subsection. In general, the BFP technique obtains an intermediate "partially compressed" state vector, $\tilde{x}(n)$, and output, $\tilde{y}(n)$, from the compressed input, $\hat{u}(n)$, the compressed state vector, $\hat{x}(n)$, and the g-controls. For the subband prototypes, this is accomplished as follows:

$$\tilde{x}_1(n+1)=-0.8\frac{g_1(n)}{g_K(n)}\hat{x}_K(n)+0.2\frac{g_1(n)}{g_u(n)}\hat{u}(n) \tag{5}$$

$$\tilde{y}(n)=1.8\frac{g_y(n-1)}{g_K(n)}\hat{x}_K(n)+0.8\frac{g_y(n-1)}{g_u(n)}\hat{u}(n)$$

where K=64. Eqn. (5) is not a standard state space, as it relates $\tilde{x}(n+1)$ to $\hat{x}(n)$. As in the previous subsection, a LUT can be used to convert from the compressed encoded signal's normalized subband samples and scale factors to scale factors that are integer powers of 2, along with the corresponding normalized subband samples. These are used as $g_u(n)$ and $\hat{u}(n)$ in Eq. (5). The remaining g-controls can be derived recursively by introducing "p-controls." Since for this example, $g_K(n)=g_1(n-K+1)$, we only need to derive $g_1(n)$ and $g_y(n-1)$, so we only need $p_1(n)$ and $p_y(n)$. The former is obtained from $\tilde{x}_1(n)$:

$$p_1(n) = \begin{cases} \frac{1}{4} & \alpha 2^N & < & |\tilde{x}_1(n)| \\ \frac{1}{2} & \alpha 2^{N-1} & < & |\tilde{x}_1(n)| \le \alpha 2^N \\ 1 & \alpha 2^{N-2} & < & |\tilde{x}_1(n)| \le \alpha 2^{N-1} \\ 2 & & & |\tilde{x}_1(n)| \le \alpha 2^{N-2} \end{cases} \quad (6)$$

where N is the number of bits used for compressed states, input, and output, and $\alpha$ is a constant "safety factor" set to be slightly less than unity. Similarly, $p_y(n)$ is obtained by an equation identical to Eq. (6), but with $\tilde{y}(n)$ replacing $\tilde{x}_1(n)$. The p-controls are used to recursively obtain g-controls:

$$g_1(n)=p_1(n)\cdot g_1(n-1)$$

$$g_y(n)=p_y(n)\cdot g_y(n-1) \quad (7)$$

The p-controls are also used to obtain the fully compressed $\hat{x}_1(n)$ and $\hat{y}(n)$ from the partially compressed $\tilde{x}_1(n)$ and $\tilde{y}(n)$:

$$\hat{x}_1(n)=p_1(n)\cdot\tilde{x}_1(n)$$

$$\hat{y}(n)=p_y(n)\cdot\tilde{y}(n) \quad (8)$$

The $K^{th}$ state is simply obtained as: $\hat{x}_K(n)=\hat{x}_1(n-K+1)$.

The p(n) and g(n) signals in Eq. (6) are integer powers of 2, and they are stored as those powers. Thus, although Eq. (6) contains ratios and products, these can be implemented as additions and subtractions of powers of 2, and bitshifts by these powers. This can result in a simpler design.

In the above description, both syllabic companding and BFP embodiments are described. In particular, syllabic companding and BFP are applied to directly process compression encoded signals before denormalization. The proposed techniques take advantage of the compressed subband samples and scale factors already provided in the compression encoded signal. The compressed input and scale factors are used as inputs to low-resolution syllabic companding or BFP processors, and processing is thus accomplished with low-resolution fixed point arithmetic.

For the number of bits used, relatively large signal to noise ratio (SNR) is achieved over a large input dynamic range. The companding nature of the processing ensures that significant quantization distortion is only present in subbands that also simultaneously contain significant signal. This property, combined with the psychoacoustical masking properties of the MPEG reconstruction filterbank, ensures that even though the processor uses low-resolution fixed-point arithmetic, the resulting quantization distortion at the processor output is significantly reduced relative to that of the classical DSP. In one example, 8-bit systems can be used to clearly illustrate the noise reduction, relative to a classical DSP, resulting from the proposed schemes. More bits can be used in commercial applications to further reduce the resulting quantization noise. The results imply that by using companding or BFP in lieu of classical processing, fewer bits are needed to achieve inaudible quantization noise.

The range of input levels that a system can tolerate may be referred to as the system's dynamic range (DR). More specifically, if $e_{max}$ is the envelope of the largest-envelope input signal that a system can tolerate without overflow, while $e_{min}$ is the envelope of the smallest-envelope input signal for which the SNR at the output of the system is still greater than some specified minimum SNR, then the DR of the system is the ratio of $e_{max}$ to $e_{min}$. Similarly, if a given signal has an envelope which is at most $e_{max}$ and at least $e_{min}$, then the DR of the signal is the ratio of $e_{max}$ to $e_{min}$. Note that if the DR of a signal is lower than that of a system, then when the signal is input to the system, provided that the signal is scaled by an appropriate constant, it will be processed with at least the minimum SNR, and will not cause overflows in the system.

In the BFP technique, only fixed-point hardware is used, but with extra scaling signals and extra operations to increase the dynamic range of the DSP. The BFP architecture allows the scaling signals to be dynamic (time-varying). The scaling-signals in the BFP technique are chosen specifically. Although most BFP architectures share a scaling signal throughout the DSP, the proposed BFP architectures of certain embodiments provide every state its own independent scaling signal.

The logarithmic number system (LNS) represents numbers using a sign bit, followed by the logarithm of the absolute value of the number. Dynamic range is increased significantly due to the compressive nature of the nonlinear logarithm function. Arithmetic operations such as addition and multiplication can take two LNS format numbers, and return the result in the LNS format. These operations are not generally implemented with standard fixed-point arithmetic units. In an LNS architecture, the DSP coefficients can be stored in the LNS format. A major advantage of LNS architectures is that multiplication and division are easily and efficiently accomplished using standard fixed-point addition and subtraction, respectively. These operations can thus be extremely efficient, and, in the absence of overflow and underflow, nearly error-free. Similarly, the computation of powers and roots is greatly simplified. However, LNS addition and subtraction is typically more complex than fixed-point addition and subtraction, and is often accomplished by resorting to lookup tables (LUTs), often including a linear interpolation algorithm.

In some embodiments, the system may be a reverberator with a delay given by a multiple of 32. The proposed techniques, though, are far more general, and can be applied to any set of subband processor prototypes. For example, the proposed techniques can be applied to a linear phase finite impulse response (FIR) filter. Additionally, a companding DSP and companding methods are further described in U.S. Pat. Nos. 7,602,320 and 6,389,445, each of which are hereby incorporated by reference herein in their entirety.

Other Applications

Other applications of the disclosed subject matter may include include, for example, providing the capability for users to manipulate (add effects) to the audio on their portable MPEG players in a very efficient manner. Currently, with typical portable MPEG players, the user selects an audio clip and plays it back. An MPEG decoder decodes the audio, and the user hears the audio, but does not have the option to add effects (echo, reverb, subwoofer, etc.).

The same functionality can be added to DVB (Digital Video Broadcast) players on portable devices, since the DVB standard uses the same standard (MP2) to which this technology can be applied for transmitting audio. While portable players are described for illustrative purposes, other audio players and DVB players can also benefit from this technology.

For example, in conventional devices that allow a user to manipulate audio, the typical device would first fully decode the MPEG and then process the manipulations to the audio. This requires the processor to have a high dynamic range, so it is more expensive and consumes more power (e.g., drain the batteries faster). In other conventional devices, processing could be done during the decode, but the processors are more complicated than those utilizing the technology described in this application. By using the technology described herein, the processing can be done during the decode in a very efficient manner, using the features of MPEG among other things. This can allow users to add effects, and the hardware used to give them this capability is relatively simple and inexpensive and does not cause significant additional power drain.

The techniques described herein can be readily applied to compressed encoded signals such as MP3 and AAC, which are used by a number of devices. The MP3 and AAC standard can be considered to be a layer on top of the MP2 standard, which allows the techniques described herein to be used quite readily. For example, the MP3 content can be partially decoded into MP2, and then the content can be processed using the techniques described above.

Although the description above focuses on a particular set of audio effects, the techniques described herein can be generalized and applied in a number of ways. With these generalized techniques, users can have a wide array of audio effects to choose from (for example an equalizer, a filter that cuts off bass effects etc.).

In the above, the processing was described as being user-selected. However, these techniques can also be used to add certain automatic effects to audio, for example, based on a user-selected template. For example, on car stereo equipment, a user typically can adjust bass, treble, etc. With the techniques described herein, users can make such adjustments (and many other types of manipulations) on their portable MPEG players, and the processing used to implement the user's selections can be made far more efficient, in terms of hardware cost and power consumption, by using these techniques.

The companding techniques presented in this disclosure could be advantageously applied whenever it is desirable to achieve high signal to noise ratio over a wide dynamic range, using relatively simple, fast, low-cost and low-power fixed-point arithmetic. For example, in high-speed wireless applications, where signals with wide dynamic range must be processed with some minimum required output signal to noise ratio (SNR), using companding could significantly simplify the processing, thus reducing the cost and power consumption. Such application could, for example, reduce the cost and improve the battery life of cell-phones, smartphones, and personal digital assistants (PDAs).

Example Embodiment

Figure 6:
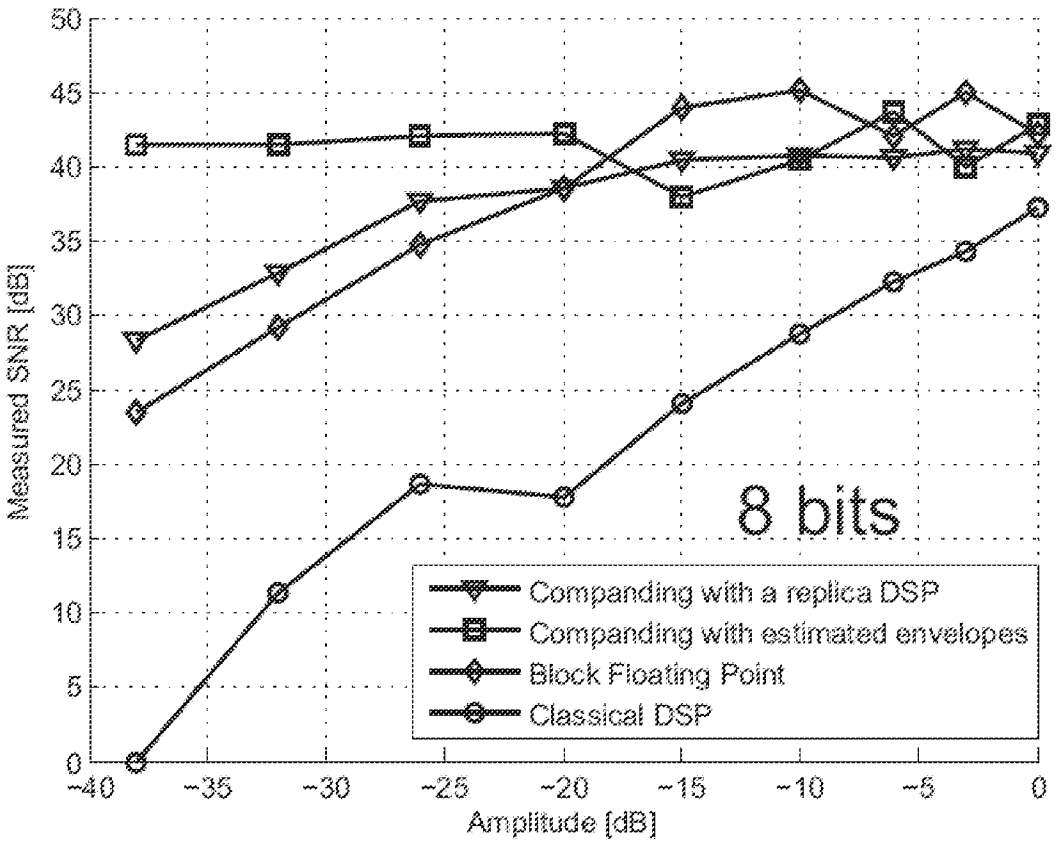
FIG. 6 illustrates a signal to noise ratio (SNR) comparison for selected test systems in accordance with certain embodiments.

The systems discussed were implemented and simulated in Matlab/Simulink with both pure-tone and speech inputs. FIG. 6 illustrates the signal to noise ratio (SNR) comparison for selected test systems when their inputs are a 500 Hz encoded tone in accordance with certain embodiments. The systems operate in 8-bit, fixed-point arithmetic, meaning that they use 8-bit registers and multipliers, and 16-bit accumulators, adders, subtracters and shifters. As shown, the SNR at the output of the companding and BFP systems is very close to the full-scale SNR over a large input dynamic range (DR); such is not the case for the 8-bit classical system. Thus, for a fixed target SNR, the companding and BFP systems can provide a much larger DR than a classical system using the same number of bits.

FIG. 6 alone does not fully determine the performance of the systems when subject to signals of varying envelopes; such performance will depend on both the SNRs in FIG. 6 and the accuracy of the envelope calculations. As such, the presented systems are also fed with audio signals, including speech signals. Listening tests confirmed that the quantization noise of the companding and BFP systems is significantly reduced relative to that of the classical DSP, due to the higher SNRs shown in FIG. 6 and the masking properties of the MPEG reconstruction filterbank.

Starting from a signal encoded in MPEG-1 Layer II, standard open-source MPEG-1 Ccode is used to partially decode the MP2 bitstream, yielding compressed (normalized) subband samples and the corresponding scale-factors. These compressed subband samples and scale-factors are passed to MATLAB, and the direct-processing algorithms described above is implemented in MATLAB/Simulink.

For the conventional fixed-point system, two versions are implemented. In the first version, referred to as the "full-rate" version, the original, full-rate, uncoded signal is processed by a conventional fixed-point implementation of the prototype reverberator (with K=2048). In the second version, referred to as the "direct-processing" version, the subband samples are denormalized using the scale-factors, and conventional fixed-point implementations of the subband prototype reverberators were used to process the denormalized subband samples. The processed subband samples are then converted into a fully-decoded signal using a MATLAB implementation of the MPEG-1 subband synthesis algorithm.

FIG. 6 shows the SNR for all systems when their inputs are (an MPEG-1 encoded) 1 kHz tone. As shown, the companding and BFP systems exhibit similar performance, and the SNR at the output of the companding and BFP systems is very close to the full-scale SNR over a large input dynamic range; such is not the case for either version of the 8-bit conventional fixed-point system. Thus, for a given target SNR, the companding and BFP systems can provide a much larger dynamic range than a conventional fixed-point system using the same number of bits. For low input signal levels, the SNRs of the companding and BFP systems are significantly better than those of the conventional fixed-point systems.

The SNR curves of FIG. 6 imply that in the companding and BFP systems, since the SNR is largely independent of signal level, the noise power decreases as the signal level decreases. For example, as shown in FIG. 6, the full-scale SNR of the syllabic companding system is roughly 39 dB, and this is also roughly the SNR of the syllabic companding system when the input level is roughly 16 dB. Thus, in the former case, the noise power is roughly 39 dB below full-scale, whereas in the latter case, the noise power is 16 dB lower, or roughly 55 dB below full-scale, so that for the syllabic companding (or for the BFP) DSP, the noise power decreases as the signal level decreases. Companding or BFP thus ensure that when signals are "small," there is very little quantization noise, even when the processing is performed with relatively low resolution fixed-point operations. In contrast, when signals are "large," there can be more significant quantization noise when the processing is performed with relatively low resolution, even when companding or BFP is used.

Although the present disclosure has been described and illustrated in the foregoing example embodiments, it is understood that the present disclosure has been made only by way of example, and that numerous changes in the details of implementation of the disclosure may be made without departing from the spirit and scope of the disclosure, which is limited only by the claims which follow.

We claim:

1. A digital signal processor comprising:

an input configured to receive signal comprising a plurality of subbands and envelope information of the plurality of subbands, wherein the envelope information indicates a dynamic range of at least one of the plurality of subbands;

a plurality of subband processors, coupled to the input, wherein each of the plurality of subband processors is configured to process a respective one of the plurality of subbands to provide a processed subband signal based on the envelope information of the one of the plurality of subbands to account for the dynamic range of the one of the plurality of subbands, wherein the one of the subband processors comprises a fixed-point signal processor configured to process the one of the plurality of subbands based on an internal state, the internal state computed based on previous values of the one of the plurality of subbands in accordance with a state-space model; and an output collector configured to provide an output signal based on the processed subband signal from each of the plurality of subband processors.

2. The digital signal processor of claim 1, wherein the one of the plurality of subband processors is configured to scale the one of the subbands using the envelope information of the one of the subbands to account for the dynamic range of the one of the plurality of subbands.

3. The digital signal processor of claim 1, wherein the envelope information comprises a scale factor indicative of the envelope information.

4. The digital signal processor of claim 1, wherein the fixed-point signal processor is further configured to process the one of the plurality of subbands based on envelope information of the internal state to account for a dynamic range of the internal state.

5. The digital signal processor of claim 4, wherein the fixed-point signal processor is configured to scale the internal state using the envelope information of the internal state to account for the dynamic range of the internal state.

6. The digital signal processor of claim 4, wherein the envelope information of the one of the plurality of subbands and the envelope information of the internal state are an integer power of 2.

7. The digital signal processor of claim 4, wherein each of the subband processors further includes an envelope generator configured to determine the envelope information of the internal state based on the envelope information of the one of the plurality of subbands, and to provide the envelope information of the internal state to the fixed-point signal processor.

8. The digital signal processor of claim 7, wherein the envelope generator is configured to determine the envelope information of the internal state by detecting changes in the envelope information of the one of the plurality of subbands.

9. The digital signal processor of claim 8, wherein if the envelope information of the one of the plurality of subbands changes by more than a pre-defined threshold, the envelope generator is configured to provide the most recent envelope information of the one of the plurality of subbands as the envelope information of the internal state.

10. The digital signal processor of claim 8, wherein if the envelope information of the one of the plurality of subbands does not change by more than a pre-defined threshold, the envelope generator is configured to provide weighted versions of past envelope information of the one of the plurality of subbands as the envelope information of the internal state.

11. A signal processing method comprising:

receiving, at an input of a digital signal processor, a signal comprising a plurality of subbands and envelope information of the plurality of subbands, wherein the envelope information indicates a dynamic range of at least one of the plurality of subbands;

processing, by each of a plurality of subband processors in the digital signal processor, a respective one of the plurality of subbands to provide a processed subband signal based on the envelope information of the one of the plurality of subbands to account for the dynamic range of the one of the plurality of subbands, wherein processing the one of the plurality of subbands comprises processing the one of the plurality of subbands based on an internal state of the one of the plurality of subband processors, the internal state computed based on previous values of the one of the plurality of subbands in accordance with a state-space model; and providing, by an output collector coupled to the plurality of subband processors, an output signal based on the processed subband signal from each of the plurality of subband processors.

12. The method of claim 11, wherein the signal is an MPEG signal.

13. The method of claim 11, wherein processing the one of the plurality of subbands further comprises processing the one of the plurality of subbands based on envelope information of the internal state to account for a dynamic range of the internal state.

14. The method of claim 13, wherein the envelope information of the one of the plurality of subbands and the envelope information of the internal state are an integer power of 2.

15. The method of claim 13, further comprising determining, at an envelope generator in the one of the subband processors, the envelope information of the internal state by detecting changes in the envelope information of the one of the plurality of subbands.

16. The method of claim 15, wherein if the envelope information of the one of the plurality of subbands does not change by more than a pre-defined threshold, providing weighted versions of past envelope information of the one of the plurality of subbands as the envelope information of the internal state.

17. A tangible, non-transitory computer readable medium including instructions operable to cause an apparatus to:

receive a signal comprising a plurality of subbands and envelope information of the plurality of subbands, wherein the envelope information indicates a dynamic range of at least one of the plurality of subbands;

process each of the plurality of subbands using the envelope information of the respective one of the plurality of subbands to provide a processed subband signal for the respective one of the plurality of subbands, wherein processing each of the plurality of subbands comprises processing the one of the plurality of subbands based on an internal state of the one of a plurality of subband processors, the internal state computed based on previous values of the one of the plurality of subbands in accordance with a state-space model; and provide an output signal by combining processed subband signals of the plurality of subbands.

18. The tangible, non-transitory computer readable medium of claim 17, wherein the envelope information comprises a scale factor indicative of the envelope information.

19. The tangible, non-transitory computer readable medium of claim 17, wherein the instructions are further operable to cause the apparatus to scale the internal state using envelope information of the internal state to account for the dynamic range of the internal state.

20. The tangible, non-transitory computer readable medium of claim 19, wherein instructions are further operable to cause an apparatus to determine the envelope information of the internal state by detecting changes in the envelope information of the one of the plurality of subbands.

* * * * *